United States Patent [19]

Yano et al.

[11] Patent Number: 4,963,248

[45] Date of Patent: Oct. 16, 1990

[54] PROCESS FOR PRODUCTION OF DIMETHYLNAPHTHALENES

[75] Inventors: Kyoji Yano; Shirou Aizawa, both of Okayama, Japan

[73] Assignee: Nippon Mining Co., Ltd., Tokyo, Japan

[21] Appl. No.: 249,160

[22] Filed: Sep. 26, 1988

[30] Foreign Application Priority Data

Sep. 24, 1987 [JP] Japan ..... 63-237428

[51] Int. Cl.[5] ..... C10G 35/04; C07C 5/22

[52] U.S. Cl. ..... 208/135; 208/136; 208/138; 585/477; 585/804; 585/812; 585/828

[58] Field of Search ..... 208/135, 136, 138; 585/477, 804, 812, 828

[56] References Cited

U.S. PATENT DOCUMENTS

| | | | |
|---|---|---|---|
| 3,055,956 | 9/1962 | Paulsen | 585/320 |
| 3,153,675 | 10/1964 | Mason | 585/304 |
| 3,249,644 | 5/1966 | Hahn | 585/304 |
| 3,870,745 | 3/1975 | Angstedt | 585/471 |
| 3,890,403 | 6/1975 | Shimado et al. | 585/481 |
| 3,936,509 | 2/1976 | Negahama et al. | 585/866 |
| 4,014,949 | 3/1977 | Hedge | 585/831 |
| 4,300,008 | 11/1981 | McCaulay | 208/134 |
| 4,536,278 | 8/1985 | Tatterson et al. | 208/89 |

FOREIGN PATENT DOCUMENTS

| | | |
|---|---|---|
| 0124328 | 11/1984 | European Pat. Off. . |
| 0164905 | 12/1985 | European Pat. Off. . |
| 960164 | 6/1964 | United Kingdom . |

OTHER PUBLICATIONS

Hydrocarbon Processing, vol. 59, No. 5, May 1980, pp. 110–114.

*Primary Examiner*—Curtis R. Davis
*Attorney, Agent, or Firm*—Sughrue, Mion, Zinn, Macpeak & Seas

[57] ABSTRACT

A process for production of dimethylnaphthalenes is disclosed, comprising subjecting a raffinate resulting from the recovery of normal paraffins from a hydrodesulfurized kerosene fraction to reforming reaction and then recovering dimethylnaphthalenes from the product oil.

9 Claims, No Drawings

PROCESS FOR PRODUCTION OF DIMETHYLNAPHTHALENES

FIELD OF THE INVENTION

The present invention relates to a process for the production of dimethylnaphthalenes from a raffinate resulting from recovery of normal paraffins from a kerosene fraction.

BACKGROUND OF THE INVENTION 2,6- or 2,7-naphthalenedicarboxylic acid obtained by oxidation of dimethylnaphthalenes, particularly 2,6- or 2,7-dimethylnaphthalene, is used as a starting material for production of polyesters such as polyethylene naphthalates. These polyesters provide synthetic fibers and films having excellent characteristics. It has therefore been desired to develop a process for producing 2,6- or 2,7-dimethylnaphthalene at low costs and with high quality.

Dimethylnaphthalenes are contained in coal tar or a cycle oil in the fluid catalytic cracking process and, thus, a method of recovering dimethylnaphthalenes by distillation of coal tar or the cycle oil has been proposed (see, for example, JP-A-60-69042 (the term "JP-A" as used herein means an "unexamined published Japanese patent application")).

In the method of recovering dimethylnaphthalenes from coal tar or the cycle oil in the fluid catalytic cracking process, since the cycle oil contains a high concentration of nitrogen and sulfur compounds, the dimethylnaphthalenes obtained are contaminated with these nitrogen and sulfur compounds. These nitrogen and sulfur compounds accelerate catalyst poisoning in isomerization of substituted dimethylnaphthalenes other than 2,6- or 2,7-dimethylnaphthalene, and further in adsorption separation of 2,6- or 2,7-dimethylnaphthalene by the use of a zeolite and so on. It is therefore necessary to decrease the amounts of nitrogen and sulfur compounds in dimethylnaphthalenes to about 10 ppm or less. Concerning hydrotreating to decrease the amounts of the nitrogen and sulfur compounds to about 10 ppm or less, it should be carried out under severe conditions. Hydrotreating under such severe conditions inevitably causes hydrogenation and cracking of dimethylnaphthalenes, resulting in a great reduction in yield of dimethylnaphthalenes. Thus, additional dehydrogenation is needed, and a problem arises in that the production cost is markedly increased.

Normal paraffins are recovered from a kerosene fraction as a starting material for production of linear alkylbenzene sulfonates (LAS) as synthetic detergents.

As a result of investigations, it has been found that a product oil obtained by reforming reaction of the above-described raffinate contains a large amount of dimethylnaphthalenes and that the product is almost free from nitrogen and sulfur compounds.

It is reported that catalytic reforming of a kerosene fraction provides heavy aromatic compounds and that the heavy aromatic compounds conta in dimethylnaphthalenes *(Sekiyu Gakkaishi,* Vol. 13, No. 6 (1970), pp. 468–474). But, astonishingly, by the reforming reaction of the raffinate, dimethylnaphthalenes can be formed in an amount of about 1.5 times that in the reforming reaction of the kerosene fraction.

SUMMARY OF THE INVENTION

An object of the present invention is to provide a process in which dimethylnaphthalenes with a low content of sulfur and nitrogen compounds can be produced in high yield.

That is, the present invention relates to a process for producing dimethylnaphthalenes which comprises subjecting a raffinate resulting from recovery of normal paraffins from a hydrodesulfurized kerosene fraction to re f or m i ng re a c t i o n a n d the n re co v e r i n g dimethylnaphthalenes from the product oil.

DETAILED DESCRIPTION OF THE INVENTION

The hydrodesulfurized kerosene fraction as referred to herein is a kerosene fraction obtained by atmospheric distillation of a crude oil or cracking oil, etc., generally a distillate within the boiling range of from 150 to 300° C., which has been subjected to de su lfuriza tio n u nd er the common 1 y us ed hydrodesulfurization conditions, for example, with catalysts prepared by supporting at least one of cobalt, nickel, molybdenum, and tungsten on a carrier such as alumina or silica-alumina and under conditions of a temperature range of from 280 to 430° C., a pressure range of from 10 to 200 kg/cm$^2$, a liquid hourly space velocity (LHSV) range of from 0.5 to 15 hr$^{-1}$, and a hydrogen recycle amount range of from 70 to 2,400 Nm$^3$/kl. A kerosene fraction with reduced sulfur and nitrogen contents to about 50 ppm or less is preferably used.

In the present invention, a raffinate resulting from the recovery of normal paraffins from the above-described hydrodesulfurized kerosene fraction is used. This recovery of normal paraffins is preferably carried out by adsorption separation using a molecular sieve, such as by the Iso-Siv method (cf. *Hydrocarbon Processing,* 59, No. 5, May, 1980, pp. 110–114), the Molex method (cf. D.B. Broughton et al., *Petrol. Refiner.,* 40(5), 173 (1961), and the BP method (cf. A.A. Yeo et al., *Six World Petroleum Congress,* Sect. IV-Paper 15 (1963)). As the raffinates, those in which at least 50% by weight, particularly from 70 to 95% by weight, of normal paraffins in the kerosene fraction are recovered are preferred from the viewpoint of yield of dimethylnaphthalenes. In this case, the order of the hydrodesulfurization and the recovery of normal paraffins is not critical. It is, however, preferred from the viewpoint of catalyst poisoning of the zeolite that the hydrodesulfurization is first carried out.

For the reforming reaction, a catalytic reforming process which is widely used for production of high-octane value gasoline from a naphtha fraction and so forth can be employed. This can be carried out by the use of, e.g., a catalyst prepared by supporting platinum alone or in combination with rhenium, germanium, tin, iridium, or ruthenium on a carrier of alumina and under conditions of a temperature range of from 400 to 550° C., a pressure range of from 1 to 100 kg/cm$^2$, a liquid hourly space velocity (LHSV) range of from 0.1 to 3 hr$^{-1}$, and a hydrogen/oil molar ratio range of from 0.5 to 20.

In another embodiment, the reforming reaction can be carried out by the use of a zeolite, or crystalline aluminosilicate, silica, alumina, zirconia, titania, chromia, solid phosphoric acid, or oxides of indium, lanthanum, manganese, cerium or tin, or acidic refractories containing a mixture of two or more thereof, or catalysts prepared which contain therein or have supported thereon metals such as platinum, palladium, and rhenium and under conditions of a temperature range of from 250 to 700° C., pressure range of from 1 to 100 kg/cm$^2$, LHSV range of from 0.1 to 20 hr$^{-1}$, and a hydrogen/oil molar ratio range of from 0.5 to 20.

The product oil after the reforming reaction contains a relatively high concentration of dimethylnaphthalenes, and the dimethylnaphthalenes are recovered by techniques such as distillation, solvent extraction, conventional crystallization, high-pressure crystallization (cf. *Kagaku Kogaku,* 51, No. 6, 428–433 (1987)), and combinations thereof. The recovery by distillation is preferred from the economic standpoint, and by collecting a 255–270° C. fraction, a high concentration of dimethylnaphthalenes can be obtained.

2,6- and 2,7-dimethylnaphthalnes are separated and recovered from the dimethylnaphthalenes by known techniques such as the adsorption separation method using a zeolite, the crystallization method, and the separation method through the formation of a complex compound. The residue after the recovery is isomerized by the use of an isomerization catalyst and recycled for the abovedescribed separation and recovery.

In accordance with the present invention, dimethylnaphthalenes are recovered from a product oil resulting from the reforming reaction of a hydrodesulfurized kerosene fraction. Thus, dimethylnaphthalenes with a low content of sulfur and nitrogen compounds can be produced in quite high yield.

The present invention is described in greater detail with reference to the following examples.

EXAMPLES 1 AND 2, AND COMPARATIVE EXAMPLE 1

A desulfurized kerosene fraction having a properties shown in Table 1,- as obtained by hydrodesulfurization of a kerosene fraction, and a raffinate having a properties as shown in Table 1, as obtained by recovering 90% by weight of normal paraffins from the above-described kerosene fraction by the use of a molecular sieve, were used as starting materials and subjected to a reforming reaction by the use of a catalytic reforming catalyst comprising an alumina carrier having supported thereon 0.2% by weight of platinum and under the conditions as shown in Table 2. Properties of the product oil and the dimethylnaphthalene content are shown in Table 2. The product oil was subjected to atmospheric distillation, and a 255° -265° C. fraction was collected. The purity of dimethylnaphthalenes was 65%.

TABLE 1

| | Desulfurized Kerosene Fraction | Raffinate |
|---|---|---|
| Specific Gravity (15/4° C.) | 0.7926 | 0.8026 |
| Viscosity (cSt, 30° C.) | 1.420 | 1.738 |
| Total Nitrogen Content (ppm) | 0.5 or less | 0.5 or less |
| Sulfur Content (ppm) | 0.1 or less | 0.1 or less |
| Water Content (ppm) | 30 | 36 |
| Composition (vol %) | | |
| Saturated | 93.5 | 88.1 |
| Unsaturated | 0.5 | 0.7 |
| Aromatic | 6.0 | 11.2 |
| Distillation Properties | | |
| Initial Distillation Point (°C.) | 181.5 | 194.5 |
| 50% Distillation Point (°C.) | 210.5 | 211.0 |
| 95% Distillation Point (°C.) | 243.0 | 242.5 |
| End Point (°C.) | 256.0 | 257.5 |
| Dimethylnaphthalene Content (wt %) | 0 | 0 |

TABLE 2

| | | Example 1 | Example 2 | Comparative Example 1 |
|---|---|---|---|---|
| Condition | Type of Oil | Raffinate | Raffinate | Desulfurized oil |
| | Temperature (°C.) | 470 | 490 | 490 |
| | Pressure (kg/cm$^2$G) | 10 | 10 | 5 |
| | LHSV (hr$^{-1}$) | 0.8 | 0.8 | 0.8 |
| | $H_2$/Oil (molar ratio) | 3 | 3 | 2 |
| Properties of Product Oil | Specific Gravity (15/4° C.) | 0.8514 | 0.8621 | 0.8569 |
| | Viscosity (cSt, 30° C.) | 1.043 | 0.9828 | 1.134 |
| | Total Nitrogen Content (ppm) | 0.5 or less | 0.5 or less | 0.5 or less |
| | Sulfur Content (ppm) | 0.1 or less | 0.1 or less | 0.1 or less |
| | Composition (%) | | | |
| | Saturated | 36.0 | 30.4 | 35.6 |
| | Unsaturated | 0 | 0 | 0 |
| | Aromatic | 64.0 | 69.6 | 64.4 |
| | Distillation Properties | | | |
| | Initial Distillation Point (°C.) | 47.5 | 45.0 | 51.5 |
| | 50% Distillation Point (°C.) | 198.0 | 198.0 | 204.5 |
| | 95% Distillation Point (°C.) | 287.0 | 302.0 | 286.0 |
| | End Point (°C.) | 310.5 | 308.0 | 311.0 |
| Composition | 2,6-Dimethylnaphthalene | 1.48 | 2.09 | 0.77 |
| | 2,7-Dimethylnaphthalene | 1.24 | 1.55 | 0.77 |
| | 1,6-Dimethylnaphthalene | 2.35 | 2.81 | 1.91 |
| | 1,2 to 1,5-Dimethylnaphthalenes | 1.67 | 4.00 | 2.23 |
| | 1,8 and 2,3-Dimethylnaphthalenes | 1.85 | 2.87 | 1.59 |
| | Total of Dimethylnaphthalenes | 8.59 | 13.32 | 7.27 |

EXAMPLES 3 to 5, AND COMPARATIVE EXAMPLE 2

Raffinates in which the percent recovery of normal paraffins was adjusted to 50% by weight and 70% by weight by adding the normal paraffins recovered in each of examples 1 and 2 to the raffinate used in each of Example 1 and 2, and for comparison, the desulfurized kerosene used in Comparative Example 1 were subjected to reforming reaction by the- use of a catalytic reforming catalyst comprising an alumina carrier having supported thereon 0.2% by weight of platinum and under the conditions of a pressure of 25 kg/cm$^2$, temperature of 490° C., LHSV of 0.8 hr$^{-1}$, and hydrogen/oil molar ratio of 6. Properties and composition of the product oil are shown in Table 3.

TABLE 3

| | | Example 3 | Example 4 | Example 5 | Comparative Example 2 |
|---|---|---|---|---|---|
| | Type of Oil and | Raffinate | Raffinate | Raffinate | Desulfurized Oil |
| | Percent Recovery (wt %) | 50 | 70 | 90 | 0 |
| Properties of Product Oil | Specific Gravity (15/4° C.) | 0.8311 | 0.8321 | 0.8343 | 0.8281 |
| | Viscosity (cSt, 30° C.) | 0.8494 | 0.8498 | 0.8513 | 0.8489 |
| | Total Nitrogen Content (ppm) | 0.5 or less | 0.5 or less | 0.5 or less | 0.5 or less |
| | Sulfur Content (ppm) | 0.1 or less | 0.1 or less | 0.1 or less | 0.1 or less |
| | Distillation Properties | | | | |
| | Initial Distillation Point (°C.) | 40.5 | 40.0 | 41.0 | 50.0 |
| | 50% Distillation Point (°C.) | 189.0 | 189.0 | 190.0 | 204.0 |
| | 95% Distillation Point (°C.) | 290.0 | 290.5 | 297.5 | 286.5 |
| | End Point (°C.) | 309.0 | 306.0 | 306.5 | 307.5 |
| Composition | 2,6-Dimethylnaphthalene | 1.54 | 1.76 | 1.81 | 1.17 |
| | 2,7-Dimethylnaphthalene | 1.56 | 1.80 | 1.84 | 1.21 |
| | 1,6-Dimethylnaphthalene | 1.54 | 2.61 | 2.63 | 1.21 |
| | 1,2 to 1,5-Dimethylnaphthalenes | 2.53 | 3.46 | 3.55 | 1.82 |
| | 1,8 and 2,3-Dimethylnaphthalenes | 2.86 | 2.57 | 2.59 | 2.52 |
| | Total of Dimethylnaphthalenes | 10.03 | 12.20 | 12.42 | 7.93 |

As is apparent from the foregoing results, by reforming reaction of a raffinate resulting from the recovery of normal paraffins from a desulfurized kerosene fraction, dimethylnaphthalenes can be obtained in the concentration of about 1.5 times that from the desulfurized kerosene fraction.

While the invention has been described in detail and with reference to specific embodiments thereof, it will be apparent- to one skilled in the art that various changes. and modifications can be made therein without departing from the spirit and scope thereof.

What is claimed is:

1. A process for producing dimethylnaphthalenes which comprises sub]ecting a raffinate resulting from the recovery of normal paraffins from a hydrodesulfurized kerosene fraction to reforming reaction and then recovering dimethylnaphthalenes from the product oil.

2. The process as claimed in claim 1, wherein the raffinate is a raffinate resulting from the recovery of at least 50% by weight of normal paraffins from a hydrodesulfurized kerosene fraction.

3. The process as claimed in claim 1, wherein the reforming reaction is carried out by the use of a catalyst prepared by supporting platinum alone or in combination with rhenium, germanium, tin, iridium, or rhuthenium on an alumina carrier and under the conditions of a temperature range of from 400° to 550° C., a pressure range of from 1 to 100 kg/cm$^2$, a liquid hourly space velocity range of from 0.1 to 3 hr$^{-1}$, and hydrogen/oil molar ratio range of from 0.5 to 20.

4. The process as claimed in claim 1, wherein the recovery of dimethylnaphthalenes is carried out by distillation, solvent extraction, crystallization, or a combination thereof.

5. The process as claimed in claim 4, wherein the recovery of dimethylnaphthalenes is carried out by distillation to collect a 255° -270° C. fraction.

6. The process as claimed in claim 1, wherein the recovery of dimethylnaphthalenes is finally the separation and recovery of 2,6- and 2,7-dimethylnaphthalenes.

7. The process as claimed in claim 1 wherein the hydrodesulfurized kerosene fraction is a kerosene fraction with reduced. sulfur and nitrogen contents to 50 ppm or less.

8. The process as claimed in claim 1, wherein the reforming reaction is carried out by the use of a catalyst comprising the least one inorganic refractory selected from the group consisting of zeolite, crystalline aluminosilicate, silica, alumina, zirconia, titania, chromia, solid phosphoric acid, indium oxide, lanthanum oxide, manganese oxide, cerium oxide and tin oxide, or a catalyst which contains therein or has supported thereon at least one metal selected from the group consisting of platinum, palladium and rhenium under the following conditions: temperature range of from 250° to 700° C.; pressure range of from 1 to 100 kg/cm$^2$; LHSV range of from 0.1 to 20 Hr$^{-1}$, and hydrogen/oil molar ratio range of from 0.5 to 20.

9. A process for producing dimethylnaphthalenes which comprises sub]ecting a raffinate resulting from the recovery of normal paraffins from a hydrodesulfurized kerosene fraction to reforming reaction; separating and recovering dimethylnaphthalenes from the product oil; separating and recovering 2,6- and 2,7-dimethylnaphthalenes from the dimethylnaphthalenes by any one or more methods. of adsorption separation, crystallization, or separation forming a complex compound; and then isomerizing the recovery residue into 2,6- and 2,7-dimethylnaphthalenes.

* * * * *